United States Patent [19]

Weber

[11] 4,312,455

[45] Jan. 26, 1982

[54] TABLE PARCEL HOLDER

[76] Inventor: Cora Weber, 7650 W. Farragut Ave., Chicago, Ill. 60656

[21] Appl. No.: 114,014

[22] Filed: Jan. 21, 1980

[51] Int. Cl.[3] ..... A47F 5/00

[52] U.S. Cl. ..... 211/86; 108/28; 248/205 A; 248/308

[58] Field of Search ..... 108/28; 211/86; 248/205 A, 308, 305, 284

[56] References Cited

U.S. PATENT DOCUMENTS

| | | | |
|---|---|---|---|
| 965,151 | 7/1910 | Benjamin | 248/308 |
| 3,637,181 | 1/1972 | Janssen | 248/205 A |
| 3,750,991 | 8/1973 | Ragir | 248/206 |
| 3,767,152 | 10/1973 | Killinger | 248/226.5 |
| 4,023,763 | 5/1977 | Pulley | 248/284 X |

*Primary Examiner*—Roy D. Frazier
*Assistant Examiner*—Robert W. Gibson, Jr.
*Attorney, Agent, or Firm*—Henry J. Gens

[57] ABSTRACT

A holding device for supporting articles such as handbags, newspapers and packages underneath a table top in a dining area, the device being provided with a pivotal attachment which can be secured to any vertical surface underneath a table or to an under-surface of the table top. The holding device is provided with one or more holding members which are pivotally supported to make the holding members more adaptable for supporting the articles whether the holding device is secured from a vertical or a horizontal table surface. The pivotal attachment may possess a reticulated construction adapted for attachment to an arcuate table surface.

1 Claim, 4 Drawing Figures

TABLE PARCEL HOLDER

BACKGROUND OF THE INVENTION

1. Field of the Invention

This invention relates to a holding device which can be attached to a vertical or a horizontal surface underneath a table top, the device being provided with holding members which can support various articles such as handbags, newspapers and packages.

2. Description of the Prior Art

Holding devices for supporting handbags from table tops of tables used for dining are already known. Examples of such prior art handbag holding devices have been described in U.S. Pat. Nos. 3,767,152; 3,773,288; 3,860,210 and 4,118,001. All of the different forms of handbag holding devices described in the foregoing patents depend for support on top of the table top and all of these devices are of a portable nature, that is, the device is carried attached to the strap of the handbag or is carried inside the handbag. A disadvantage of such handbag holders wich are supported from the top of the table is that they occupy a space which is at a premium in congested dining areas particularly where very small tables are used for serving a large number of diners. Another disadvantage of such temporary table top supported holders is that they may be accidentally brushed off the table top causing the supported handbag to fall on the floor.

SUMMARY OF THE INVENTION

The article holders of this invention are in the form of holding devices which can be readily attached to a vertical surface underneath a table top or to a horizontal under-surface of the table top. The holding device is provided with a pivotal securement which can be readily attached either to a vertical or a horizontal surface of the table. The holding device is provided with one or more holding members which can support a number of articles such as handbags provided with holding straps, purses without straps, newspapers and packages. The holding member may be in the form of a hook, a clamp or a receptacle which may be open ended and which is pivotally secured so that one of the open ends can be pivoted downwardly to facilitate the insertion of a package. The holding members are preferably pivotally secured to the holding device so that articles can be easily supported by the holding device irrespective of the attachment to the table, whether to a vertical or to a horizontal surface underneath the table top. The holding device is provided with an attachment which can be secured to an arcuate vertical or horizontal surface of the table.

Accordingly, it is an object of the present invention to provide a holding device for supporting articles underneath the table top of a dining table by attachment to either a vertical or a horizontal surface of the table.

Another object of the invention is to provide a holding device for supporting articles underneath the table top of a dining table by attachment to an arcuate horizontal or vertical surface.

Another object of the invention is to provide a holding device having one or more holding members which are pivotally secured to the device so that articles may be easily supported from the device, depending on whether the device is secured to a vertical or a horizontal surface of the table.

A further object of the invention is to provide a holding device having one or more holding members, one of which is in the form of a receptacle for supporting an article such as a package.

A still further object of the invention is to provide a holding device provided with one or more holding members, one of which is in the form of a clamp.

Other objects, features and advantages of the invention shall become apparent from the description hereinafter set out when considered in conjunction with the accompanying illustrative drawings.

DETAILED DESCRIPTION OF THE INVENTION

Figure 1:
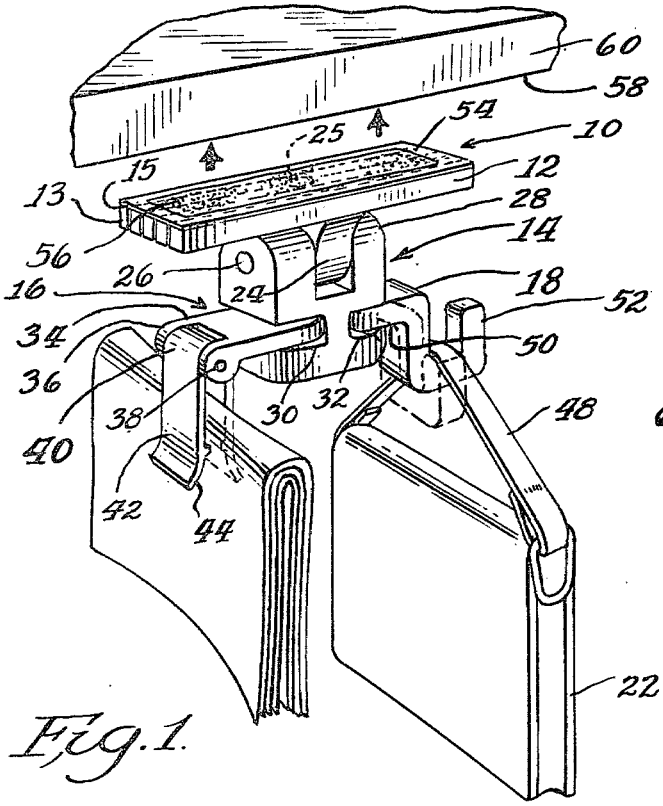
FIG. 1 is a perspective view of a holding device attachable to the under-surface of a table top for supporting therefrom articles such as a newspaper and a handbag.

The preferred embodiment of the invention is shown in FIG. 1, wherein a holding device 10 comprises an attaching member 12 pivotally connected to a body 14 which pivotally supports holding members 16 and 18 for supporting articles such as a newspaper 20 and a handbag 22, respectively. Attaching member 12 has a centrally located ear 24 pivotally connected by a pin 26 to a pair of spaced ears 28 extending out of the body 14 which has a pair of slots 30 and 32 for pivotally supporting the holding members 16 and 18 by means of pins (not shown).

The attaching member 12 may have a solid construction or it may have, as shown in FIG. 1, a reticulated construction having a plurality of elongated members 13 integrally supported by a flexible backing plate 15 which can readily conform to any arcuate surface on a table to which the holding device is to be attached. In the event that the attaching member 12 has a reticulated construction, it is preferred that the ear 24 pivotally support the attaching member by a pivot 25 (hidden lines) so that the attaching member can swivel with respect to the coupled ear for purposes to be described later.

The holding member 16 has a body portion 34 having an inner end connected by a pivot pin (not shown) in the slot 30 of the body 14. The outer end of the body portion 34 is provided with a pair of spaced ears 36 which support, by means of a pivot pin 38, a clamp 40 provided with a pair of jaws 42 provided with diverging ends 44 which facilitate the introduction of a bulky article such as a newspaper into the jaws 42 of the clamp 40.

Figure 2:
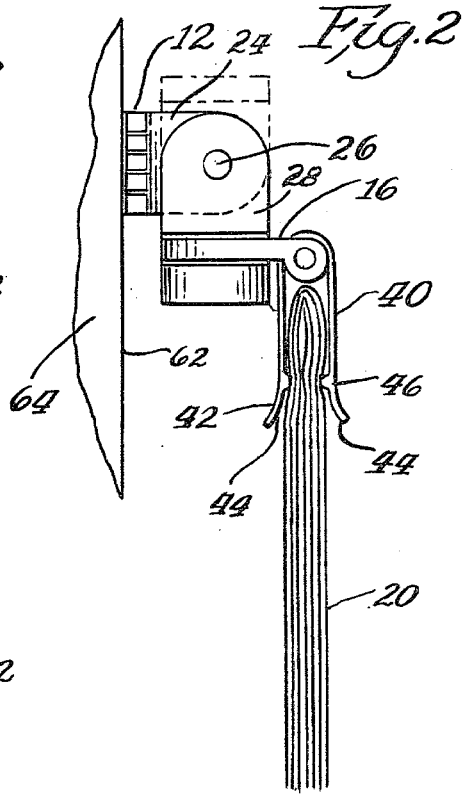
FIG. 2 is a side view of the holding device attached to a vertical surface of a table.

As shown in FIG. 2, the clamp 40 is also provided with interior jaws 46 which provide a better friction hold for retaining an inserted article such as the newspaper 20. Also, the interior jaws 46 will prevent an article having a smooth surface from slipping or falling out, for example such as a strap 48 on the handbag 22. The clamp 40 is provided with a spring (not shown) which biases the jaws 42 together.

The holding member 18 is in the form of a hook having a pivot portion 50 engaged in the slot 32 by a pivot pin (not shown). The free end of the holding member 18 is defined by a hook portion 52 for supporting the handbag 22 via the strap 48.

The attaching member 12 has a surface 54 provided with an adhesive 56 for attaching the holding device 10, as shown by the arrows, to an under-surface 58 of a table top 60.

Since the attaching member 12 is pivotally connected to the body 14, the attaching member 12 can be attached to a vertical surface 62 on a table leg 64, as shown in FIG. 2. Of course, if the table top 60 has a border framework underneath, the attaching member 12 can be attached to the vertical surface of the framework.

As shown in FIG. 2, the holding member 16 has been pivoted to extend from the front of the holding device 10, as opposed from the side position shown in FIG. 1. This pivotal arrangement of the holding members 16 and 18 provides sufficient spacing from the table leg 64 so that articles can be conveniently suspended from the holding members 16 and 18.

If the table leg 64 had an arcuate shape, the attaching member 12 would be pivoted with respect to the ear 24 so that the longitudinal axis of the attaching member would align with the table leg 64 before the adhesively covered surface 54 on the attaching member 12 is pressed against the table leg 64.

The pivotal connection between the ear 24 and the attaching member 12 and the pivotal connection between the ear 24 and the body 14 combine to impart swivel characteristics to the holding device.

Figure 3:
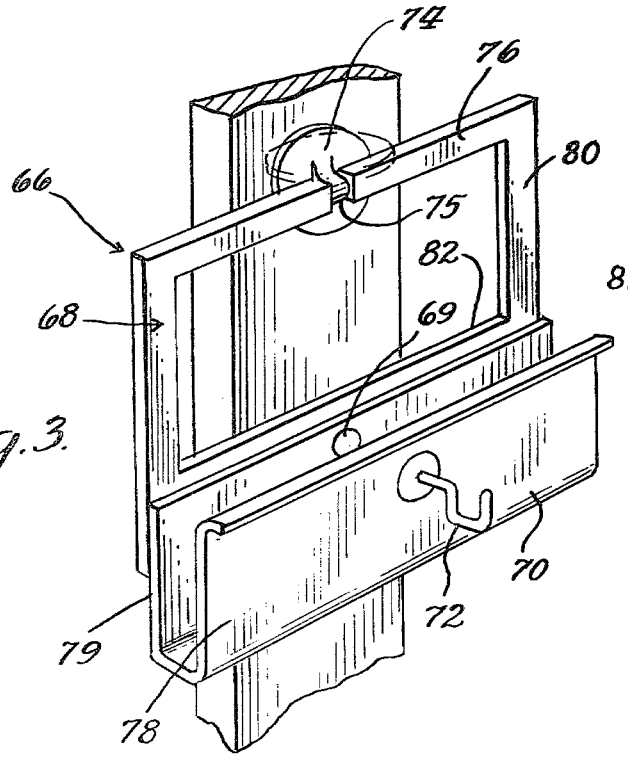
FIG. 3 is an alternate embodiment of the holding device provided with a holding member in the form of a receptacle and a further holding member in the form of a hook.

An alternate embodiment of the invention is shown in FIG. 3, wherein a holding device 66 comprises a body 68 pivotally supporting via a pivot 69 a holding member in the form of an open-ended receptacle 70 which has a pair of upstanding walls 78 and 79. The holding device 66 is adapted to be secured to either a vertical or a horizontal surface on a table (not shown) by means of an attaching member 74 which is pivotally coupled by an ear 75 to a cross member 76 on the body 68. The ear 75 engages a bearing portion (hidden) centrally located on the cross member 76. A holding member 72, in the form of a hook, is affixed to a central portion of the wall 78 of the receptacle 70. The cross member 76 is connected by upstanding members 80 to a main portion 82 of the body 68. The receptacle 70 is pivotally supported by the pivot 69 so that it can be declined to facilitate the introduction of an article into the open-ended receptacle 70. This is of particular importance if the holding device 66 has short upstanding members 80, so that the space between the table top and the receptacle 70 is limited.

Figure 4:
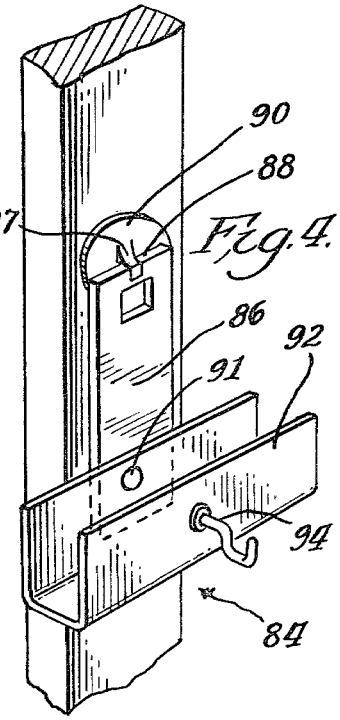
FIG. 4 is another form of the holding device shown in FIG. 3, except that it possesses a simplified structure.

The modified embodiment shown in FIG. 4 compares essentially with the embodiment shown in FIG. 3, except that a more simplified construction is used for the body, wherein a holding device 84 has a rectangular body 86 provided with a cross member 88 to which is pivotally connected an ear 87 on an attaching member 90 which can be secured to a vertical or a horizontal surface on a table. The ear 87 engages a bearing portion (hidden) centrally located on the cross member 88. The other end of the rectangular body 86 pivotally supports by means of a pivot 91 a holding member 92 in the form of an open ended receptacle to which is secured a holding member 94 in the form of a hook adapted to support articles provided with a bail or a strap, such as on the handbag 22.

The attaching members 74 and 90 shown respectively in FIGS. 3 and 4 are in the form of a suction cup which can be readily attached to either a vertical or a horizontal surface on a table.

Although the attaching member 12 uses an adhesive and the attaching members 74 and 90 use suction cups, it is manifest that other forms of attaching members can be used. For example, the attaching members can employ various magnetic structures which can be attached to a table provided with ferromagnetic surfaces. As a further alternative, the attachment between the holding device and the table surface may be obtained with the use of a plastic fastener commonly known as Velcro (TM).

Although the present invention was developed for permanent securement to a table, it can be used with other types of securement for detachably attaching the holding device to the table.

While there are shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A holding device for supporting articles underneath the top of a dining table, comprising an attaching member for attachment to a surface beneath the table top, a body having one or more holding members for supporting said articles, connecting means for pivotally connecting said body to said attaching member, said attaching member comprising a rectangular element having a pair of parallel opposing faces, one of said faces being engaged by said connecting means, and an adhesive covering the other of said faces, said rectangular element being pivotally secured to said connecting means, the face opposite said adhesively covered face being reticulated along the longitudinal axis of said element, said means connecting said body to said attaching member comprising at least one ear on said attaching member and at least one ear on said body, and a pivot member coupling said ears together, whereby said attaching member is pivotable with respect to said body to permit the attachment of said attaching member to a horizontal or vertical surface of the table, and whereby said pivotable securement and said reticulated face permit said element to be attached to an arcuate surface of said table.

* * * * *